US008672813B2

(12) United States Patent
West

(10) Patent No.: US 8,672,813 B2
(45) Date of Patent: Mar. 18, 2014

(54) REBOUNDING ARENA CONSTRUCTION SYSTEMS

(76) Inventor: Karl J. West, Orem, UT (US)

( * ) Notice: Subject to any disclaimer, the term of this patent is extended or adjusted under 35 U.S.C. 154(b) by 138 days.

(21) Appl. No.: 13/113,885

(22) Filed: May 23, 2011

(65) Prior Publication Data

US 2011/0287899 A1 Nov. 24, 2011

Related U.S. Application Data

(60) Provisional application No. 61/396,191, filed on May 24, 2010.

(51) Int. Cl.
*A63B 5/11* (2006.01)

(52) U.S. Cl.
USPC ..... 482/27; 482/23; 482/26; 482/28

(58) Field of Classification Search
USPC ..... 482/26–32; 5/230–231, 235, 246, 5/248–249, 252–253, 256; 273/395–396; 473/434–435, 454
See application file for complete search history.

(56) References Cited

U.S. PATENT DOCUMENTS

| | | | | |
|---|---|---|---|---|
| 3,233,895 | A * | 2/1966 | Grelle et al. | 482/27 |
| 4,381,861 | A | 5/1983 | Howell, Jr. | |
| 4,386,772 | A | 6/1983 | Wu | |
| 6,129,649 | A * | 10/2000 | Yang | 482/27 |
| 6,162,061 | A | 12/2000 | Taylor | |
| 6,659,914 | B2 | 12/2003 | Plante | |
| 6,840,891 | B2 | 1/2005 | Publicover | |
| 6,846,271 | B2 * | 1/2005 | Publicover | 482/27 |
| 7,094,181 | B2 | 8/2006 | Hall | |
| 7,331,903 | B2 * | 2/2008 | Nissen et al. | 482/27 |
| 7,396,318 | B2 * | 7/2008 | VanElverdinghe et al. | 482/27 |
| D614,715 | S | 4/2010 | Mann | |
| 7,766,795 | B2 | 8/2010 | Publicover | |
| 7,789,803 | B2 | 9/2010 | Plante et al. | |
| 7,794,360 | B2 | 9/2010 | Publicover | |
| 7,833,131 | B2 | 11/2010 | Rote | |
| 7,833,132 | B2 | 11/2010 | Hylbert et al. | |
| 7,927,255 | B2 | 4/2011 | Publicover et al. | |
| 2010/0035730 | A1 | 2/2010 | Dukart | |
| 2010/0210422 | A1 | 8/2010 | Crawford | |
| 2010/0317490 | A1 | 12/2010 | Alexander | |

* cited by examiner

*Primary Examiner* — Loan Thanh
*Assistant Examiner* — Gregory Winter
(74) *Attorney, Agent, or Firm* — Adam D. Stevens; Kirton McConkie

(57) ABSTRACT

A trampoline arena system having a reduced non-reboundable area includes a mattress, an outer support element substantially surrounding and connected to an outer edge of the mattress, and an inner support element providing support to the mattress at a location interior from the outer edge of the mattress. The inner support element may be completely and contiguously surrounded by the mattress. The trampoline arena system may include first and second support members in a parallel spaced relationship, a first mattress joined to the first support member by a first plurality of springs such that at least one of the first mattress and the first plurality springs passes under the second support member, and a second mattress joined to the second support member by a second plurality of springs such that at least one of the second mattress and the second plurality of springs passes under the first support member.

10 Claims, 6 Drawing Sheets

100

400

REBOUNDING ARENA CONSTRUCTION SYSTEMS

CROSS-REFERENCE TO RELATED APPLICATIONS

This application claims the benefit of U.S. Provisional Application No. 61/396,191, filed May 24, 2010.

BACKGROUND OF THE INVENTION

1. Field of the Invention

The present invention relates to systems and methods for constructing a trampoline arena, and more particularly to systems and methods for reducing the span, frequency, or overall percentage of non-reboundable area in the surface area of a trampoline arena by providing a unique inner area supporting system.

2. Background and Related Art

Trampoline arenas have become common in many cities throughout the world. They provide a place for children of all ages to enjoy physical activity that cannot be easily obtained the same way in any other type of facility. These facilities can be heavily used for sports, fun, fitness, as well as a relaxing diversion for busy parents. They are very popular for children of all ages as well as young adults.

Although trampolines have long been used as singular units commonly found in people's back yards, since trampoline arenas provide a vastly larger area to roam and play various games they therefore have a greater appeal to some users of trampolines. Even though to date many trampoline arenas have been constructed around the world, none have heretofore utilized a system of inner support mechanisms in addition to external support as is presently common place.

Today, the most common method of construction for a trampoline arena is to attach a multiplicity of individually-framed trampolines together side by side in order to produce a large surface area that is reboundable, as is illustrated in FIG. 1. Each trampoline includes a frame 101 and supporting springs 102 attached to a trampoline mattress 103. A configuration such as that shown in FIG. 1 tends to produce a great deal of space that is required by the springs 102 and steel supporting framework. Invariably there is a great deal of cushioning required to protect users from these areas, so they will not be severely injured by coming into contact with the steel supportive frame 101 or springs 102. These areas can be quite wide, absorbing a significant percentage of the reboundable area, and can be a nuisance for the business owner and the user as well as a safety hazard for the user specifically.

BRIEF SUMMARY OF THE INVENTION

Implementation of the invention provides a trampoline arena system having a reduced non-reboundable area. According to certain implementations of the invention, the trampoline arena system includes a reboundable surface, an outer support element substantially surrounding and connected to an outer edge of the reboundable surface, and an inner support element providing support to the reboundable surface at a location interior from the outer edge of the reboundable surface.

The reboundable surface may include a plurality of mattresses. One of the plurality of mattresses may be supported by an internal frame disposed within a second of the plurality of mattresses such that the second of the plurality of mattresses has a contiguous surface surrounding the internal frame. Additionally or alternatively, two long adjacent mattresses may be joined at a single support structure. Additionally or alternatively, two adjacent mattresses may be joined to a two-support system such that one of the adjacent mattresses passes under a first support and is joined to the second support by elastic support members and the other of the adjacent mattresses passes under the second support and is joined to the first support by elastic support members. The elastic support members may be springs or any other applicable device.

In some implementations, the reboundable surface includes a contiguous mattress completely surrounding the inner support element. The inner support element may include a platform, a trampoline frame supporting an inner mattress and simultaneously supporting an outer mattress completely surrounding the trampoline frame, a support column, which may be one of a network of support columns, each support column being surrounded by and supporting the reboundable surface, and/or an inflatable column. Where the inner support element is an inflatable column, the reboundable surface may be unbroken at the inflatable column.

According to certain implementations of the invention, a trampoline arena system having a reduced non-reboundable area includes a reboundable surface including a trampoline mattress, an outer support element substantially surrounding and connected to an outer edge of the trampoline mattress by a plurality of elastic elements, and an inner support element providing support to the reboundable surface at a location interior from the outer edge of the reboundable surface, wherein the inner support element is completely and contiguously surrounded by the trampoline mattress.

In some such implementations, the inner support element may include a trampoline frame supporting an inner mattress and simultaneously supporting an outer mattress completely surrounding the trampoline frame. In some implementations, the inner support element may include a support column that may be one of a network of support columns, each support column being surrounded by and supporting the trampoline mattress. In some implementations, the inner support element may include an inflatable column, and the trampoline mattress may be unbroken at the inflatable column.

According to certain implementations of the invention, a trampoline arena system having a reduced non-reboundable area includes a first support member, a second support member connected to the first support member in a parallel spaced relationship to define an inter-mattress space, a first trampoline mattress joined to the first support member by a first plurality of elastic support members such that at least one of the first trampoline mattress and the first plurality of elastic support members passes under the second support member, and a second trampoline mattress joined to the second support member by a second plurality of elastic support members such that at least one of the second trampoline mattress and the second plurality of elastic support members passes under the first support member. In such implementations, the first plurality of elastic support members and the second plurality of elastic support members are interspersed within the inter-mattress space.

The first plurality of elastic support members and the second plurality of elastic support members may include springs or any other type of elastic mattress-supporting device. The first and second support members may be part of a trampoline frame supporting the second trampoline mattress entirely within and surrounded by the first trampoline mattress.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
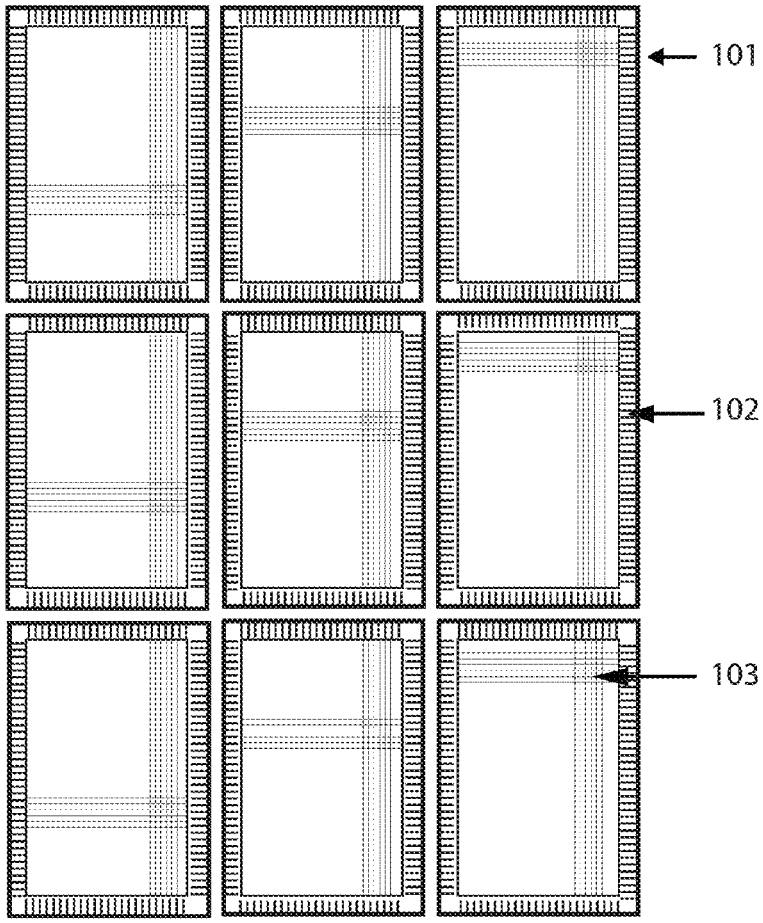
Fig 1 (Prior Art)
FIG. 1 shows a prior art configuration of a plurality of trampolines into a trampoline arena.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Embodiments of the invention provide a trampoline arena system having a reduced non-reboundable area. According to certain embodiments of the invention, the trampoline arena system includes a reboundable surface, an outer support element substantially surrounding and connected to an outer edge of the reboundable surface, and an inner support element providing support to the reboundable surface at a location interior from the outer edge of the reboundable surface.

The reboundable surface may include a plurality of mattresses. One of the plurality of mattresses may be supported by an internal frame disposed within a second of the plurality of mattresses such that the second of the plurality of mattresses has a contiguous surface surrounding the internal frame. Additionally or alternatively, two long adjacent mattresses may be joined at a single support structure. Additionally or alternatively, two adjacent mattresses may be joined to a two-support system such that one of the adjacent mattresses passes under a first support and is joined to the second support by elastic support members and the other of the adjacent mattresses passes under the second support and is joined to the first support by elastic support members. The elastic support members may be springs or any other applicable device.

In some embodiments, the reboundable surface includes a contiguous mattress completely surrounding the inner support element. The inner support element may include a platform, a trampoline frame supporting an inner mattress and simultaneously supporting an outer mattress completely surrounding the trampoline frame, a support column, which may be one of a network of support columns, each support column being surrounded by and supporting the reboundable surface, and/or an inflatable column. Where the inner support element is an inflatable column, the reboundable surface may be unbroken at the inflatable column.

According to certain embodiments of the invention, a trampoline arena system having a reduced non-reboundable area includes a reboundable surface including a trampoline mattress, an outer support element substantially surrounding and connected to an outer edge of the trampoline mattress by a plurality of elastic elements, and an inner support element providing support to the reboundable surface at a location interior from the outer edge of the reboundable surface, wherein the inner support element is completely and contiguously surrounded by the trampoline mattress.

In some such embodiments, the inner support element may include a trampoline frame supporting an inner mattress and simultaneously supporting an outer mattress completely surrounding the trampoline frame. In some embodiments, the inner support element may include a support column that may be one of a network of support columns, each support column being surrounded by and supporting the trampoline mattress. In some embodiments, the inner support element may include an inflatable column, and the trampoline mattress may be unbroken at the inflatable column.

According to certain embodiments of the invention, a trampoline arena system having a reduced non-reboundable area includes a first support member, a second support member connected to the first support member in a parallel spaced relationship to define an inter-mattress space, a first trampoline mattress joined to the first support member by a first plurality of elastic support members such that at least one of the first trampoline mattress and the first plurality of elastic support members passes under the second support member, and a second trampoline mattress joined to the second support member by a second plurality of elastic support members such that at least one of the second trampoline mattress and the second plurality of elastic support members passes under the first support member. In such embodiments, the first plurality of elastic support members and the second plurality of elastic support members are interspersed within the inter-mattress space.

The first plurality of elastic support members and the second plurality of elastic support members may include springs or any other type of elastic mattress-supporting device. The first and second support members may be part of a trampoline frame supporting the second trampoline mattress entirely within and surrounded by the first trampoline mattress.

Embodiments of the present invention relate to systems, designs, and methods for construction of a trampoline arena. Each embodiment serves to provide a combination of inner and outer mattress support in any variety of geometrical configurations and patterns in relation to each other such as to reduce as much partitional obstacles while maximizing the total reboundable surface area of the trampoline arenas. Accordingly, in each embodiment, various designs can reduce the span or regularity of non-reboundable structures or areas that frequently act as unnecessary obstacles and may prevent injury.

Trampoline arenas in accordance with embodiments of the invention may often be constructed or assembled and used in a single location for long periods of time. In other instances, however, a trampoline arena may be constructed or assembled at a location for a fixed period of time, or for an indeterminate period of time. For example, a trampoline arena may be constructed for a fair, convention, or other event, and may be moved from place to place from time to time. Similarly, a business may construct or assemble a trampoline arena at a location, intending that the trampoline arena remain for some period of time, but circumstances may dictate that the trampoline arena be moved to another location. Therefore, embodiments of the invention embrace trampoline arena constructions of types that can be readily-disassembled and/or that are intended to remain securely in place for long periods of time. The frames and other elements of embodiments of the invention can thus be assembled using any method of assembly, including, without limitation, welding, bolting, bracing, pinning, gluing/cementing, secured and unsecured nesting structures, and the like. Where structures in accordance with embodiments of the invention are to be more permanent in nature, they may be more permanently affixed to underlying and/or surrounding structures, such as by being cemented in place.

Figure 2:
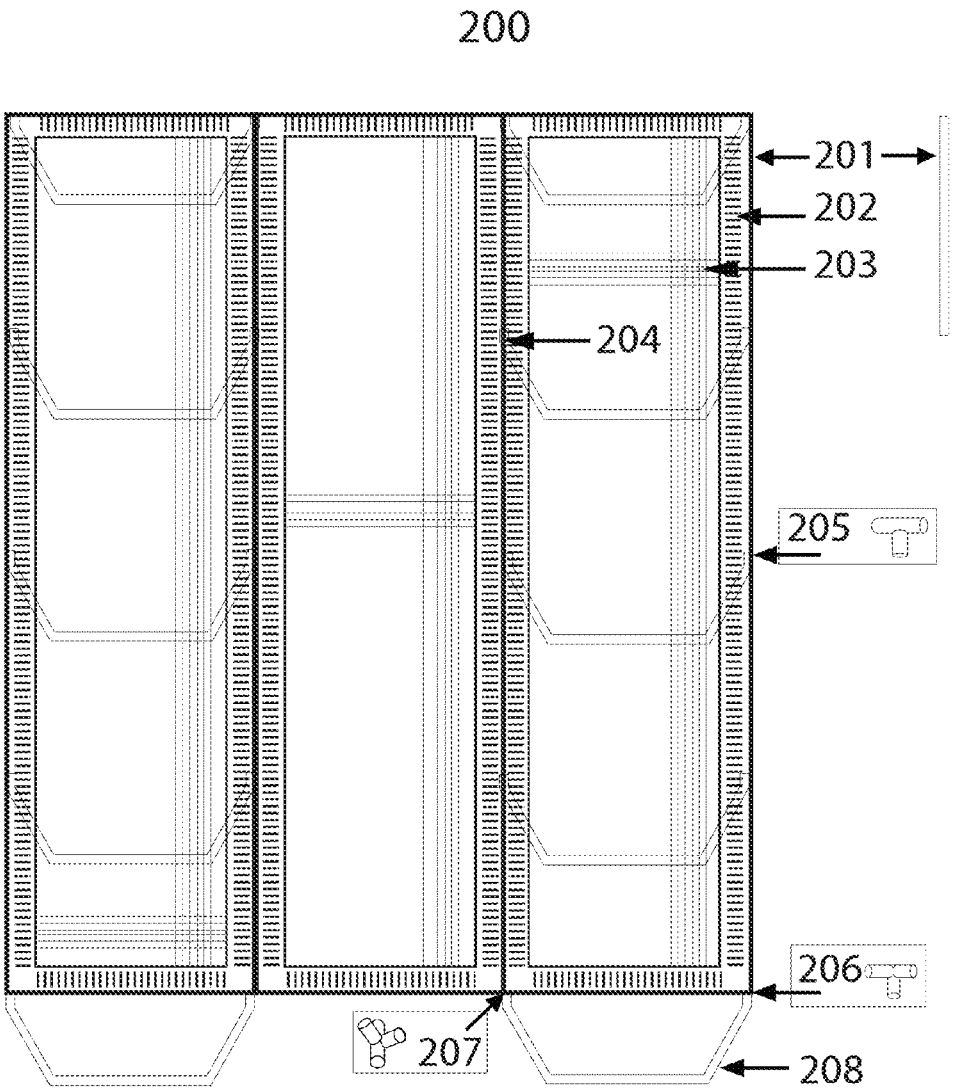
FIG. 2 shows a trampoline arena system having an increased-percentage reboundable area.

FIG. 2 illustrates a first improved embodiment of a trampoline arena that reduces non-reboundable areas of the arena. In this embodiment, the trampoline arena is constructed using a plurality of side frame elements 201, to which springs 202 (which may be essentially similar to any type of conventional springs or other elastic elements used with existing trampolines) are connected so as to support trampoline mattresses 203. The trampoline mattresses 203 differ from the mattresses 103 of FIG. 1 in that they are significantly elongated such that there are no interruptions in the reboundable surface of the area in one direction of the trampoline arena. Otherwise, the mattresses 203 may be essentially similar to existing trampoline mattresses, having similar materials and weaving, etc.

The use of the long mattresses 203 provides a significant reduction in non-reboundable areas of the trampoline arena, but is not the only feature reducing the non-reboundable areas of the trampoline arena. In addition to the use of side frame elements 201 along the sides of the trampoline arena, the trampoline arena includes inner frame elements 204. The inner frame elements 204 may differ from the side frame elements 201 or may be essentially similar, but regardless, as is illustrated in FIG. 2, the inner frame elements 204 provide for the attaching of the springs 202 on both sides of the inner frame elements 204. In this way, each inner frame element 204 simultaneously supports springs 202 supporting two of the mattresses 203. This configuration further reduces the non-reboundable area in between the mattresses 203, as the space required for two frame elements (as in FIG. 1) is reduced to the space for a single frame element. Thus, while a non-reboundable area still exists in between the mattresses 203, the distance between mattresses 203 is reduced.

FIG. 2 shows additional features of the trampoline arena to illustrate construction of the frame. While FIG. 2 shows three mattresses 203 of a given length forming the trampoline arena, the construction system illustrated in FIG. 2 may be used to form a trampoline arena of any number of mattresses 203 of essentially any length. The construction system is essentially modular and extensible, and can be expanded simply by adding additional components and, if necessary, obtaining mattresses 203 of a different length accordingly. Thus, in the construction system of FIG. 2, the side frame elements 201 and the inner frame elements 204 (whether identically formed or not) are joined by appropriate joining elements such as a T-joint 205, a corner joint 206, and a 4-way joint 207. Where appropriate, 5-way joint may be used as part of the frame. The T-joints 205, the corner joints 206, the 4-way joints 207 and/or other joints or connectors join the side frame elements 201 and the inner frame elements 204, and also connect to trampoline legs 208, which elevate the trampoline arena surface above an underlying surface as with a conventional trampoline.

As discussed above, the embodiment of FIG. 2 shows a system having a series of elongated mattresses 203 arranged side-by-side in a matrix of mattresses 203 that is N mattresses 203 wide and just one mattress 203 long to form the trampoline arena. Further, as discussed above, the length of the trampoline arena of FIG. 2 can be changed by using longer mattresses 203. In fact, the use of longer mattresses 203 may actually reduce the overall cost of the trampoline arena (beyond the cost savings of eliminating certain frame elements when compared with the system of FIG. 1), as a significant cost of manufacturing the mattresses 203 is the edge reinforcement, and having a single long mattress 203 will less total edge area than several shorter mattresses.

The width of the arena can be changed by varying the width of the mattresses 203, at least to some extent (i.e. within the limits of ready manufacturing capability, as the cost for manufacturing mattresses having widths exceeding current manufacturing capability could be quite high due to machinery costs), and can also be changed by varying the number N of mattresses 203 placed side-by-side to form the matrix of mattresses 203 in the arena. In some instances, the length of the trampoline arena can also be modified by increasing the number M of mattresses 203 placed end-to-end, such that the trampoline arena includes a matrix of mattresses 203 that is N mattresses 203 wide and M mattresses 203 long. For example, such a construction may be used where mattresses 203 of a desirable length are not readily available. Where two mattresses 203 join end-to-end, it will be understood that one or more of the inner frame elements 204 may be used to reduce the non-reboundable area between the mattresses 203 connected end-to-end.

Figure 3:
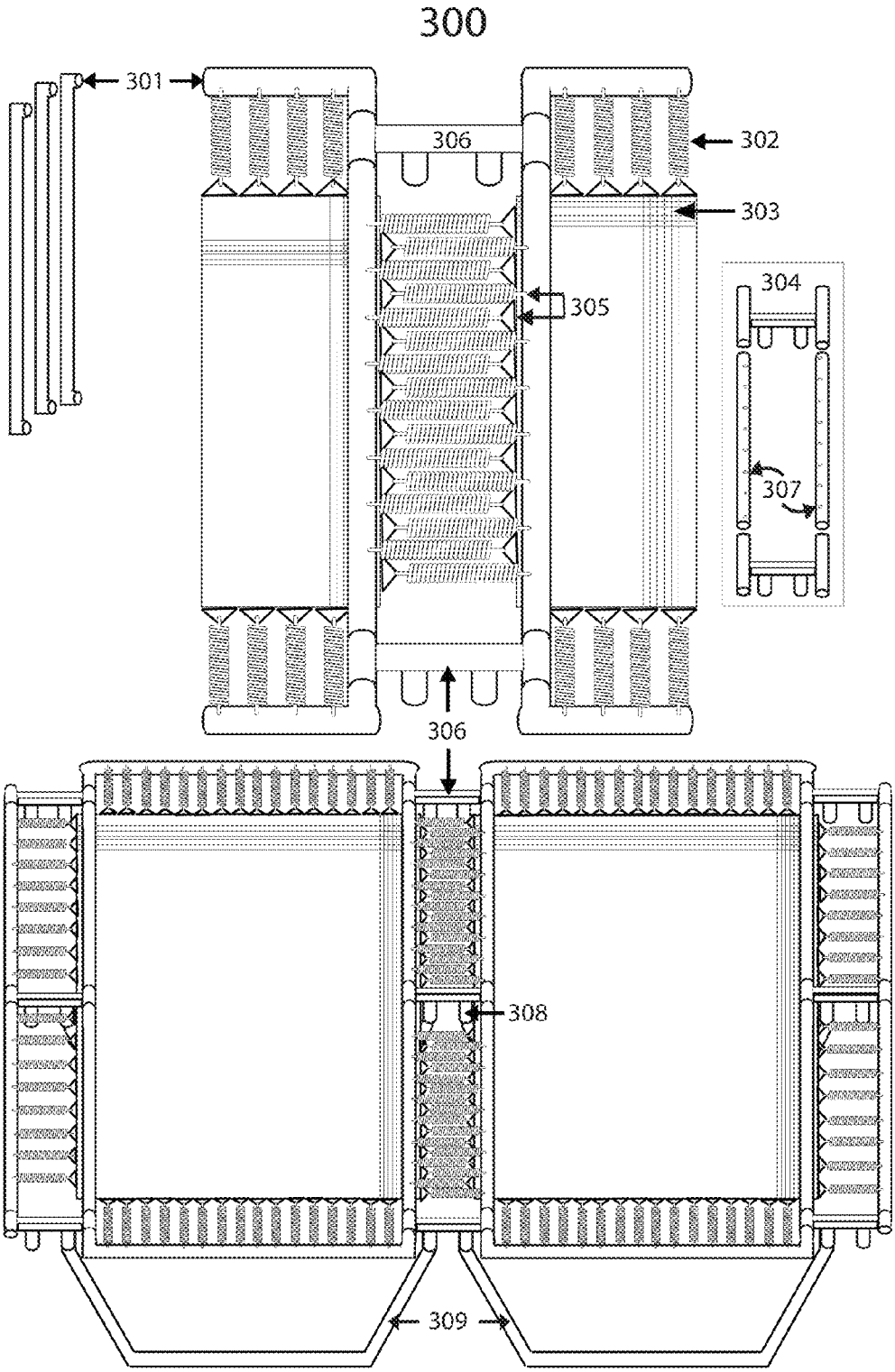
FIG. 3 illustrates a construction method for use with adjoining trampoline mats that reduces the non-reboundable area between the trampoline mats.

While FIG. 2 shows a system that reduces the non-reboundable area between trampoline mattresses 203, there is still a significant non-reboundable area in such embodiments. Therefore, FIG. 3 illustrates a two-bar construction method that may be used with certain embodiments of the invention to further reduce the non-reboundable area between trampoline mattresses. In this embodiment, the non-reboundable area and the distance between reboundable portions of adjacent trampoline mattresses may be reduced by approximately half. In the illustrative construction, end frame elements 301 are used that may be substantially similar to frame elements now known and used for trampolines generally. Similarly, a plurality of springs 302 are shown, which may be essentially similar to springs or other elastic elements used with known trampolines, and are connected to trampoline mattresses 303, which are essentially similar to existing mattresses. While the view of FIG. 3 illustrates short mattresses 303 or at least a short representative area for ease of illustration only, it should be understood that the features of the embodiment shown in FIG. 3 may be used with long mattresses 303 of the type illustrated and discussed with respect to FIG. 2.

In the two-bar construction system, which is further detailed in inset 304, an offset spring pattern 305 is used to permit springs 302 of adjacent mattresses 303 to occupy a similar inter-mattress space without interfering with each other. Where the springs 302 are very closely spaced (which may only be necessary in certain instances), adjacent springs 302 may be provided with a cover, sock or other device to reduce or prevent adjacent springs 302 from interfering with each other, entangling with each other, or creating undue noise from impact or rubbing. Each cover, sock, or other device may be made of a fabric or material capable of stretching or flexing with the springs 302. As may be seen by referencing the offset spring pattern 305, the springs 302 occupy an inter-mattress space defined by a spacer joint 306, which serves as the only joint for the illustrated embodiment. The spacer joints 306 are attached to the end frame elements 301 as well as to a series of inner frame elements 307. As best illustrated in the inset 304, the inner frame elements 307 include offset attachment points (e.g. holes, loops or any known attachment mechanism or structure) to which the springs 302 are attached. The offset attachment point pattern allows an identical inner frame element 307 to be used on each side, with the inner frame element 307 reversed on one side to provide the offset pattern between the two sides of the two-bar construction.

Within the inter-mattress space, the springs 302 are connected to the attachment points on the inner frame element 307 on one side of the inter-mattress space, and are then attached to the opposite mattress 303, whereby one or both of the springs 302 and/or the opposite mattress 303 pass underneath the opposite inner frame element 307 as shown. In this way, as the user jumps on the mattress 303, the mattress 303 is free to descend underneath the inner frame element 307, and bouncing on the mattress 303 is essentially unrestricted. The springs 302 of the other mattress 303 similarly are attached to the opposite inner frame element 307 and the springs 302 and/or the other mattress 303 pass underneath the first inner frame element 307, such that bouncing on the other mattress 303 is similarly essentially unrestricted.

While in some embodiments, the springs 302 may extend underneath the opposite inner frame elements 307 when the mattress 303 is in the resting position, it is anticipated that such a placement of the springs 302 may result in unwanted noise in certain circumstances due to the springs 302 impacting the inner frame elements 307. Therefore, in the embodiment illustrated in FIG. 3, the springs 302 themselves do not extend under the opposite inner frame members 307, and the mattresses 303 instead extend under the inner frame elements 307. As is illustrated by the placement of descending attachment points 308 shown in FIG. 3, the extension of the mattresses 303 underneath the inner frame elements 307 in this fashion dictates that the descending attachment points 308 to which trampoline legs 309 are centrally located on the spacer joint 306 to ensure that the mattresses 303 do not impact the descending attachment points 308 or legs 309.

It will be appreciated that the use of certain alternatives to the springs 302 (e.g. stretch bands) may not involve similar noise issues and that such alternatives may optionally extend underneath the inner frame elements 307 instead of the mattress 303. In such circumstances, the descending attachment points 308 may be placed more outward in the inter-mattress space. It will also be understood that when the springs 302 are under higher tension due to a user jumping on the mattress 303, the springs 302 may stretch and pass under the inner frame elements 307.

Figure 4:
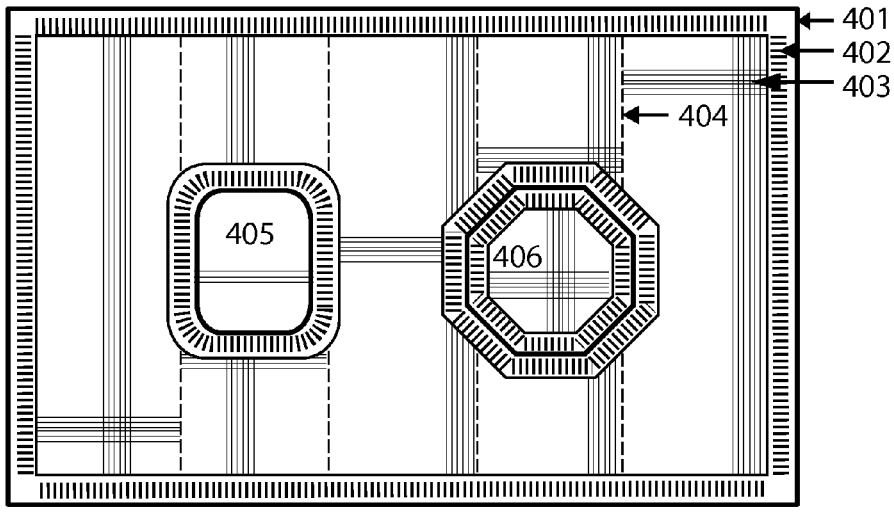
FIG. 4 shows a trampoline arena system having an increased-percentage reboundable area.
Figure 4A:
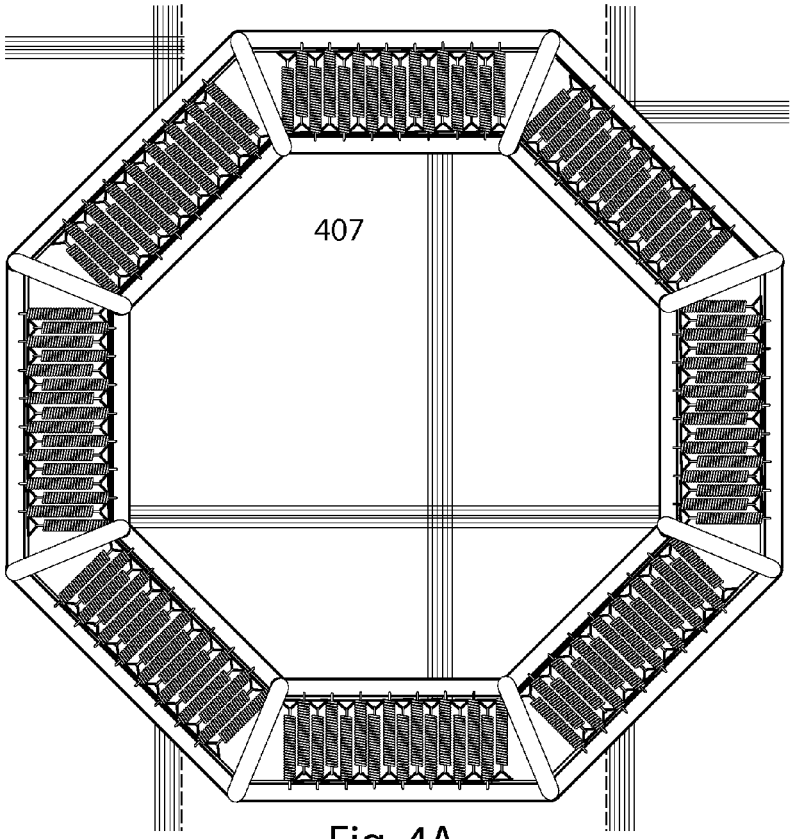
FIG. 4A shows a trampoline arena system having an increased-percentage reboundable area and utilizing a dual-bar frame structure as shown and discussed with respect to FIG. 3.
Figure 5:
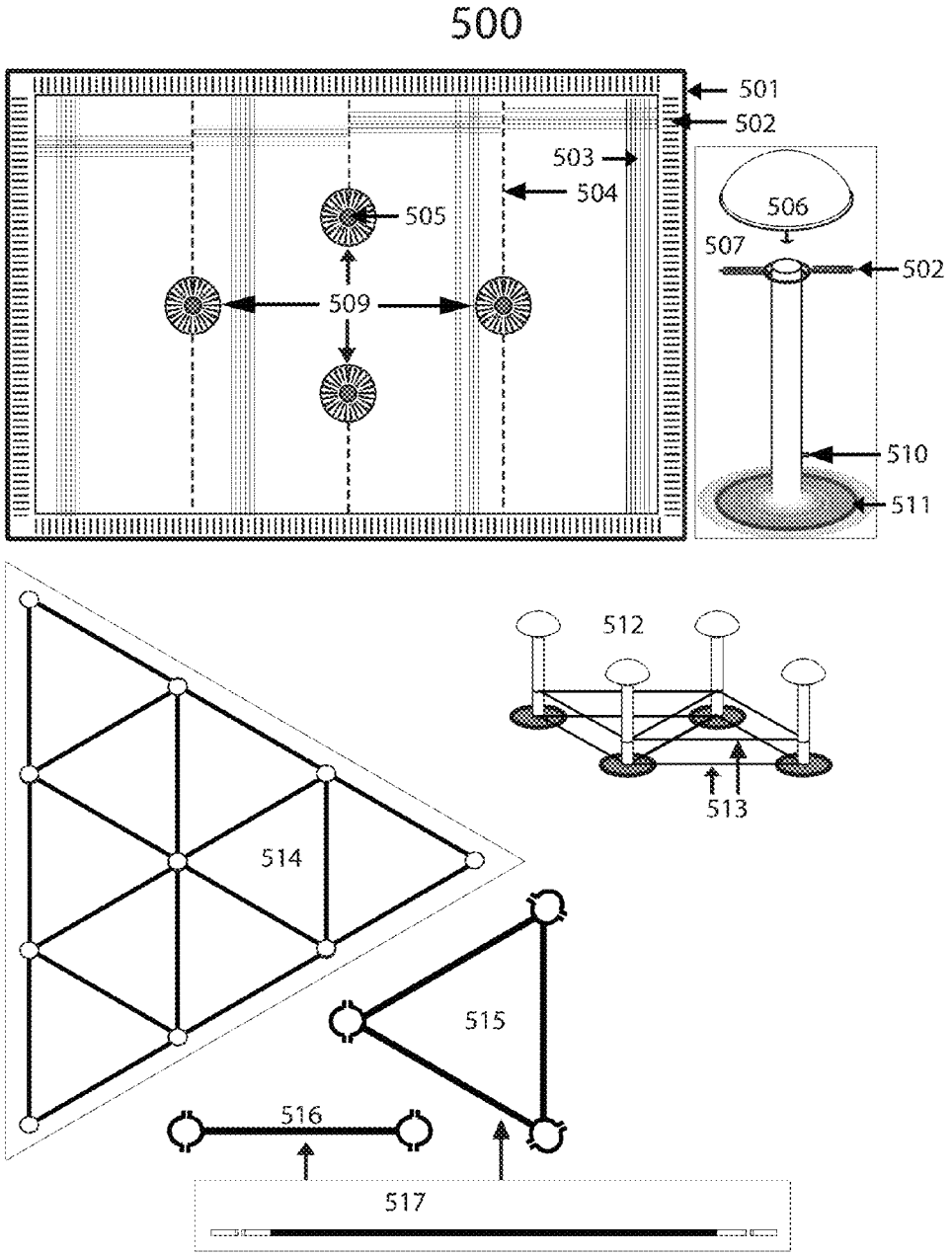
FIG. 5 illustrates features of a trampoline arena system having an increased-percentage reboundable area.
Figure 6:
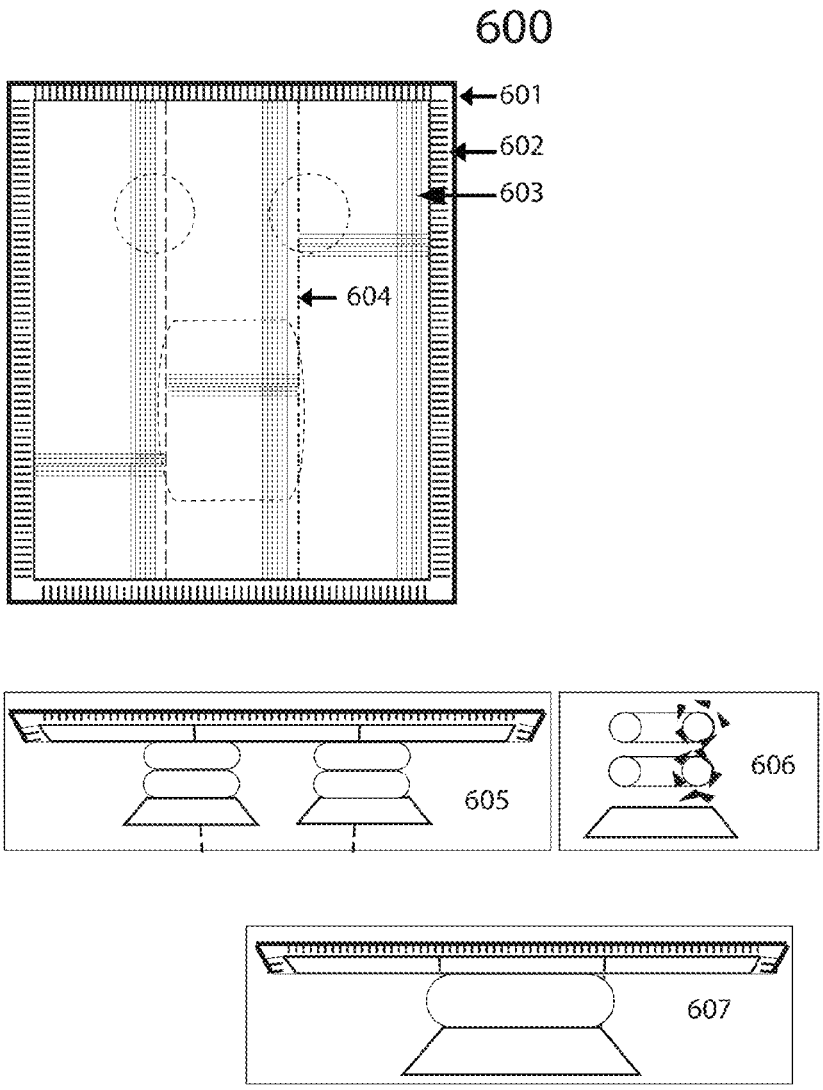
FIG. 6 illustrates features of a trampoline arena system having an increased-percentage reboundable area.

While the embodiments of FIGS. 2 and 3 provide trampoline arenas with reduced non-reboundable areas separating mattresses that may reach widths limited only by typical manufacturing processes and the effective width of such mattresses that can be sufficiently supported by external supports and framework, FIGS. 4-6 illustrate features of embodiments that are enhanced through the use of internal mattress supports of various configurations. Using such configurations, trampoline arenas incorporating reboundable widths can be achieved that are significantly greater than can be achieved with external supports alone.

Thus, FIG. 4 shows features of a representative trampoline arena. In the trampoline arena of FIG. 4, an essentially-typical external framework 401 is provided. The external framework 401 supports springs 402 or other mattress-supporting elements that are attached to a mattress 403. The mattress 403 is essentially typical of existing trampoline mattresses in most regards, except that the mattress 403 may be significantly greater in dimensions than existing mattresses, especially in the width dimension. Thus, the mattress 403 may be constructed by joining a plurality of elongate mattress sections at one or more seams 404. Of course, it should be appreciated that manufacturing processes may be altered so as to permit constructing the mattress 403 as a single non-seamed mattress if desired and if increased manufacturing costs so permit. In some instances, the seams 404 may be provided at locations designed to correspond to internal support structures discussed below.

A standard trampoline having dimensions similar to those illustrated in FIG. 4 and having only external supporting members would fail to function as is typically desired for trampolines and/or trampoline arenas. For example, a user bouncing or even just standing near the middle of such a trampoline would likely impact a surface underlying the trampoline. Therefore, in the trampoline arena construction of FIG. 4, a pair of internal supports internally support the mattress 403. The first internal support is a rigid platform 405. The platform 405 is a simple example of an internal support, and may have any desired shape (here a rounded rectangle), with the mattress 403 having a cutout conforming to and encompassing the shape of the platform 405. Springs 402 attach the mattress 403 to the platform 405, thereby providing sufficient support to the mattress 403 around the platform 405 for the mattress 403 to perform as is typically expected of a trampoline and/or trampoline arena.

While the platform 405 provides an internal support to the mattress 403 and permits a great reduction in non-reboundable area in the portions of the mattress 403 surrounding the platform 405, it will be appreciated that the platform 405 represents a significant non-reboundable area. To reduce the non-reboundable area of an internal support, the platform 405 may be replaced by a nested trampoline 406, which is essentially a second trampoline within the area of the mattress 403, or a trampoline within a trampoline. In the illustration of FIG. 4, the nested trampoline 406 is octagonal in shape, although the nested trampoline 406 may be of any desired shape.

The nested trampoline 406 may utilize either of the construction methods illustrated in FIGS. 2 and 3, as is illustrated by the alternative depictions of the upper and lower portions of FIG. 4. Thus, the nested trampoline 406 may utilize a single-bar frame structure as shown and discussed with respect to FIG. 2, with springs 402 extending from both sides of the single-bar frame structure. Alternatively, the nested trampoline 406 may utilize a dual-bar frame structure as shown and discussed with respect to FIG. 3. In either case, a nested mattress 407 serves to provide an additional reboundable area within the framework of the nested trampoline 406. In this way, the non-reboundable area of the trampoline arena can be further reduced. Although not shown in FIG. 4, a variety of supporting legs or other support devices support the external and internal support elements of the trampoline arena at appropriate locations.

FIG. 5 shows an alternative trampoline arena construction with internal supports. As with the trampoline arena of FIG. 4, the trampoline arena includes an essentially-typical external framework 501. The external framework 501 supports springs 502 or other mattress-supporting elements that are attached to a mattress 503. The mattress 503 is essentially typical of existing trampoline mattresses in most regards, except that the mattress 503 may be significantly greater in dimensions than existing mattresses, especially in the width dimension. Thus, the mattress 503 may be constructed by joining a plurality of elongate mattress sections at one or more seams 504. Of course, it should be appreciated that manufacturing processes may be altered so as to permit constructing the mattress 503 as a single non-seamed mattress if desired and if increased manufacturing costs permit. In some instances, the seams 504 may be provided at locations designed to correspond to internal support structures discussed below.

To provide sufficient internal support for the mattress 503, this embodiment utilizes a plurality of internal support columns 505 topped with cushioned covers 506. The cushioned covers 506 may be dome shaped and may be cushioned in any desirable fashion, such as by being inflated or inflatable and/or by containing a cushioning material. The cushioned covers 506 may also include an underlying firm plate or platform providing shape or support to the cushioned covers 506. Inset 507 shows an enlarged exploded view illustrating one construction of an assembly of a support column 505 and cushioned cover 506. A plurality of springs 502 or equivalent spring-like devices are attached near the top of the support column 505 and radiate outward therefrom to support the mattress 503 around the support column 505. The springs 502 at the support column 505 may be identical to the springs 502 attached to the external framework 501, or they may differ, such as by being lighter-duty or heavier-duty springs, as appropriate to provide a desired rebounding characteristic to the mattress 503.

The cushioned cover 506 is attached to the support column 505 above the springs 502 such that the cushioned cover 506 completely or largely covers the springs 502 and the support column 505. The support columns 505 are interspersed within the interior of the trampoline arena in a pattern designed to provide sufficient and desired internal support to the mattress 503, as is illustrated at 509. For example, as illustrated in FIG. 5, the support columns 505 may be interspersed in a pattern of one or more equilateral triangles. A pattern such as this may be essentially extended to essentially any size of trampoline arena, with only very minor non-reboundable areas. Indeed, the cushioned covers 506 may provide sufficient rebound such that there is essentially no non-reboundable area within the mattress 503.

As may be seen in inset 507, the support columns 505 may include features that facilitate securing the support columns 505 against unwanted movement while the trampoline arena is in use. To secure the support columns 505 against such movement, bracing may be extended between the support columns 505 and potentially from one or more of the support columns 505 to portions of the exterior framework 501 or legs depending therefrom. Because the area between the support columns is located below reboundable portions of the mattress 503, the bracing between the support columns is placed low enough to prevent the user jumping on the mattress 503 from impacting the bracing.

While some bracing may be placed immediately adjacent an underlying surface, it is anticipated that improved stability may be achieved through the use of additional bracing slightly above the underlying surface. Therefore, the support columns 505 may be provided with a notch or tab 510 designed to support a level of bracing at an appropriate level that is above the underlying surface but below an anticipated lowest extension of the mattress 503 during use. In addition to any bracing provided to the support columns 505, a wide base 511 may be provided to each support column. The base 511 may be welded to the support column post and may then be laminated, glued, welded, or bolted to an underlying surface so that the support column 505 is essentially immovable.

Inset 512 shows a perspective view of a two-triangle arrangement of four support columns 505, showing how bracing 513 may be formed at two levels, at or near the underlying surface, and slightly above that, to provide further connection, support, and rigidity to the support columns 505. While inset 512 shows a two-triangle configuration of four support columns 505, this configuration may be essentially indefinitely extended to any desirable number of support columns 505, as illustrated at 514, which shows how the equilateral triangle configuration, as it is extended, extends into a hexagonal configuration. While essentially any type of bracing may be used in between the support columns 505, one type of bracing 513 is illustrated at 515, which includes tie bars or tie rods connected to clamps configured to clamp on to the posts of the support columns 505. Such a configuration may be used at each support level of the bracing 513.

While FIG. 5 largely illustrates an internal support configuration relying on an equilateral triangle configuration, it should be understood that any desirable internal support configuration, such as rectangular, round, or square could be used, as appropriate. Thus, instead of the type of bracing 513 illustrated at 515, a different type or configuration 516 of bracing may be used where appropriate. Regardless, 517 illustrates a side view of an individual component of the bracing.

As correct placement of the support columns 505 may be important to ensuring that a proper tension is placed on all areas of the mattress 503, an exemplary method of assembling the trampoline arena will be described. In the method, the support columns 505 are individually assembled as necessary, at least potentially without the cushioned covers. Before the support columns 505 are secured to the underlying surface, the bracing is assembled between the support columns 505 to ensure that they are properly spaced. The network of support columns 505 may then be placed within the external framework 501 at an appropriate location, such as by careful measurement, and may then be secured to the underlying surface by any appropriate method. Alternatively, the support columns 505 may be secured by friction and their weight alone. Where more permanent affixation is appropriate, the support columns 505 may be cemented in place or otherwise essentially permanently affixed. Thereafter, the mattress 503 is extended within the trampoline arena and is secured to the support columns 505 by the springs 502, and then to the external framework 501 by the springs 502. The exact order of attaching the springs 502 to the support columns 505 and to the external framework 501 may be varied as desired. The cushioned covers 506 are then secured atop the support columns 505.

As may be appreciated, proper placement of the network of support columns 505 may be difficult, even with attempts at precise measurement. Therefore, an alternate assembly method may be used in some circumstances. In the alternate assembly method, the network of support columns 505 is place within the external framework 501 without being secured to the underlying surface. The mattress 503 is then connected to the external framework 501 and to the support columns 505 as discussed above, which allows a determination and adjustment of correct placement of the network of support columns 505. If necessary, some springs 502 may be omitted at this stage to permit access below the mattress 503. Once correct placement of the network of support columns 505 is achieved, the support columns 505 are then secured to the underlying surface and assembly is completed as discussed above.

While the embodiment of FIG. 5 reduces the non-reboundable area even further over the embodiments of FIGS. 2-4, and while the cushioned covers 506 may retain some amount of rebounding, the embodiment of FIG. 6 provides a trampoline arena having an uninterrupted rebounding surface. Therefore, the embodiment of FIG. 6 provides a maximum reduction in non-reboundable area, although portions of the area of the trampoline arena may have differing rebounding characteristics.

In FIG. 6, the trampoline arena includes an essentially-typical external framework 601. The external framework 601 supports springs 602 or other mattress-supporting elements that are attached to a mattress 603. The mattress 603 is essentially typical of existing trampoline mattresses in most regards, except that the mattress 603 may be significantly greater in dimensions than existing mattresses, especially in the width dimension. Thus, the mattress 603 may be constructed by joining a plurality of elongate mattress sections at one or more seams 604. Of course, it should be appreciated that manufacturing processes may be altered so as to permit constructing the mattress 603 as a single non-seamed mattress if desired and if increased manufacturing costs permit.

The internal supports for the mattress 603 of the embodiment of FIG. 6 are provided by inflatable columns as are illustrated in 605. The inflatable column may include one or more tube-like inflatable elements as well as one or more underlying support members. The inflatable elements of the inflatable columns are provided with an inflation pressure so as to arrive at a desired rebounding and support characteristic. The inflatable column may be secured to an underlying surface and may even be secured to the mattress 603, such as by a hook-and-loop fastener system. If desired, the mattress 603 may be marked so as to signify where the inflatable columns are located so users will know to anticipate potentially-different rebound characteristics.

Where the inflatable columns include more than one inflatable element, the inflatable elements may be surrounded by a woven material or case to unite the inflatable elements, as illustrated at 606. Because inflatable columns can be varied in size and shape, any number of inflatable columns can be used, including a single large inflatable column, as shown at 607.

While specific embodiments have been discussed above, it should be understood that the foregoing embodiments are intended to be exemplary and not limiting of the scope of the claimed invention or the possible configurations of a trampoline arena. Embodiments of the invention embrace the combined use of any of the embodiments and features discussed above, as well as the use of standard trampoline constructions and configurations in conjunction with any embodiment discussed herein.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A trampoline arena system having a reduced non-reboundable area comprising:

a reboundable surface;

an outer support element substantially surrounding and connected to an outer edge of the reboundable surface; and an inner support element comprising a first bar and a second bar substantially parallel to the first bar, the inner support element providing support to at least two adjacent mattresses of the reboundable surface at a location interior from the outer edge of the reboundable surface, wherein a portion of the reboundable surface distal the second bar passes under the first bar and is joined to the second bar by elastic support members and a portion of the reboundable surface distal the first bar passes under the second bar and is joined to the first bar by elastic support members.

2. The trampoline arena system as recited in claim 1, wherein the reboundable surface comprises a plurality of mattresses.

3. The trampoline arena system as recited in claim 2, wherein two long adjacent mattresses are joined at a single support structure.

4. The trampoline arena system as recited in claim 2, wherein the elastic support members are springs.

5. A trampoline arena system having a reduced non-reboundable area comprising:

a first support member comprising a first frame bar;

a second support member comprising a second frame bar, wherein the second frame bar is connected to the first frame bar in a parallel spaced relationship to define an inter-mattress space;

a first trampoline mattress joined to the first frame bar by a first plurality of elastic support members such that an element selected from the first trampoline mattress and the first plurality of elastic support members passes under the second frame bar; and a second trampoline mattress joined to the second frame bar by a second plurality of elastic support members such that an element selected from the second trampoline mattress and the second plurality of elastic support members passes under the first frame bar;

whereby the first plurality of elastic support members and the second plurality of elastic support members are interspersed within the inter-mattress space.

6. The trampoline arena system as recited in claim 5, wherein the first plurality of elastic support members and the second plurality of elastic support members comprise springs.

7. A trampoline arena system having a reduced non-reboundable area comprising:

a reboundable surface comprising a plurality of mattresses;

an outer trampoline frame comprising substantially horizontal frame bars substantially surrounding and connected to an outer edge of the reboundable surface;

an inner trampoline frame comprising a first frame bar and a second frame bar arranged in a substantially parallel, horizontally spaced relationship;

a first mattress of the plurality of mattresses joined to the first frame bar by a first plurality of elastic support members such that an element selected from the first mattress and the first plurality of elastic support members passes under the second frame bar; and a second mattress joined to the second frame bar by a second plurality of elastic support members such that an element selected from the second mattress and the second plurality of elastic support members passes under the first frame bar.

8. The trampoline arena system as recited in claim 7, wherein the elastic support members comprise springs.

9. The trampoline arena system as recited in claim 7, wherein the trampoline arena system comprises a plurality of the inner trampoline frames, each inner trampoline frame comprising its respective first frame bar and second frame bar and having:

one of the plurality of mattresses connected to the first frame bar by a first plurality of elastic support members such that an element selected from the one of the plurality of mattresses and the first plurality of elastic support members connected to the one of the plurality of mattresses passes under the second frame bar; and a second of the plurality of mattresses connected to the second frame bar by a second plurality of elastic support members such that an element selected from the second of the plurality of mattresses and the second plurality of elastic support members connected to the second of the plurality of mattresses passes under the first frame bar.

10. The trampoline arena system as recited in claim 7, wherein the reboundable area comprises a matrix of the plurality of mattresses, where any two adjacent mattresses of the reboundable area are separated by and joined to an inner trampoline frame.

* * * * *